US009662917B2

(12) United States Patent
Shinkai

(10) Patent No.: US 9,662,917 B2
(45) Date of Patent: May 30, 2017

(54) PRINTING CONTROL APPARATUS, PRINTING MANAGEMENT METHOD, AND PRINTING SYSTEM

(71) Applicant: SEIKO EPSON CORPORATION, Tokyo (JP)

(72) Inventor: Masanari Shinkai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 14/811,147

(22) Filed: Jul. 28, 2015

(65) Prior Publication Data

US 2016/0023492 A1 Jan. 28, 2016

(30) Foreign Application Priority Data

Jul. 28, 2014 (JP) ..... 2014-152642

(51) Int. Cl.

| | |
|---|---|
| ***B41J 11/00*** | (2006.01) |
| ***B41J 15/04*** | (2006.01) |
| ***B65H 26/06*** | (2006.01) |
| ***B41J 29/38*** | (2006.01) |
| ***B41J 3/46*** | (2006.01) |

(52) U.S. Cl.

CPC ..... *B41J 29/38* (2013.01); *B41J 3/46* (2013.01); *B41J 11/0075* (2013.01); *B41J 15/042* (2013.01); *B65H 26/06* (2013.01); *B65H 2553/40* (2013.01)

(58) Field of Classification Search

CPC ..... B41J 11/0075; B41J 15/042; B65H 26/06; B65H 2553/40

See application file for complete search history.

(56) References Cited

U.S. PATENT DOCUMENTS

| | | | | |
|---|---|---|---|---|
| 2004/0184858 | A1* | 9/2004 | Maruyama | B41J 15/02 400/103 |
| 2010/0245876 | A1* | 9/2010 | Nakamaru | B41J 11/485 358/1.12 |
| 2011/0211888 | A1* | 9/2011 | Fujinaga | B41J 13/0009 399/403 |
| 2012/0051824 | A1* | 3/2012 | Omori | B41J 11/009 400/611 |
| 2012/0081740 | A1* | 4/2012 | Takagi | G06F 3/1205 358/1.15 |
| 2013/0015285 | A1* | 1/2013 | Uruma | B65H 18/103 242/420.5 |

FOREIGN PATENT DOCUMENTS

| | | |
|---|---|---|
| JP | 2002-044344 A | 8/2002 |
| JP | 2010-006535 A | 1/2010 |
| JP | 2011-002901 A | 1/2011 |

* cited by examiner

*Primary Examiner* — Kristal Feggins
*Assistant Examiner* — Kendrick Liu
(74) *Attorney, Agent, or Firm* — Workman Nydegger

(57) ABSTRACT

There is provided a printing control apparatus that is communicably connected to a printing apparatus, the printing control apparatus including a medium information obtaining unit that obtains medium information from the printing apparatus, the medium information including at least one of amount information of a medium mounted in the printing apparatus and mounted state information of the medium, a screen generating unit that generates an information display screen according to the medium information, and a display unit that displays the information display screen.

4 Claims, 9 Drawing Sheets

41

FIG. 4A

411

| PAPER INFORMATION | | | | |
|---|---|---|---|---|
| 412 | 413 | 414 | 415 | 416 |
| ADAPTER MOUNTED | PAPER TYPE SET | PAPER WIDTH OBTAINED | REMAINING AMOUNT INFORMATION OBTAINED | PAPER REMAINING |
| 1 | 1 | 1 | 1 | 1 |
| 1 | 1 | 1 | 1 | 0 |
| 1 | 1 | 1 | 0 | 1 |
| 1 | 1 | 1 | 0 | 0 |
| 1 | 1 | 0 | 1 | 1 |
| 1 | 1 | 0 | 1 | 0 |
| 1 | 1 | 0 | 0 | 1 |
| 1 | 1 | 0 | 0 | 0 |
| 1 | 0 | 1 | 1 | 1 |
| 1 | 0 | 1 | 1 | 0 |
| 1 | 0 | 1 | 0 | 1 |
| 1 | 0 | 1 | 0 | 0 |
| 1 | 0 | 0 | 1 | 1 |
| 1 | 0 | 0 | 1 | 0 |
| 1 | 0 | 0 | 0 | 1 |
| 1 | 0 | 0 | 0 | 0 |
| 0 | 1 | 1 | 1 | 1 |
| 0 | 1 | 1 | 1 | 0 |
| 0 | 1 | 1 | 0 | 1 |
| 0 | 1 | 1 | 0 | 0 |
| 0 | 1 | 0 | 1 | 1 |
| 0 | 1 | 0 | 1 | 0 |
| 0 | 1 | 0 | 0 | 1 |
| 0 | 1 | 0 | 0 | 0 |
| 0 | 0 | 1 | 1 | 1 |
| 0 | 0 | 1 | 1 | 0 |
| 0 | 0 | 1 | 0 | 1 |
| 0 | 0 | 1 | 0 | 0 |
| 0 | 0 | 0 | 1 | 1 |
| 0 | 0 | 0 | 1 | 0 |
| 0 | 0 | 0 | 0 | 1 |
| 0 | 0 | 0 | 0 | 0 |

431

433

TO FIG. 4B

FIG. 4B

421

FROM FIG. 4A

| DISPLAY INFORMATION | | | | | |
|---|---|---|---|---|---|
| 422 | 423 | 424 | 425 | 426 | 427 |
| STATE MESSAGE | ACTION MESSAGE | PAPER ROLL ICON | PAPER TYPE DISPLAY CONTENT | PAPER WIDTH DISPLAY CONTENT | PAPER REMAINING AMOUNT DISPLAY CONTENT |
| UNDEFINED | PRINTING AVAILABLE | DISPLAYED | PAPER TYPE NAME CHARACTER | WIDTH VALUE | REMAINING AMOUNT VALUE |
| NO PAPER REMAINING | PLEASE INSERT MORE PAPER | | | | |
| REMAINING PAPER AMOUNT UNKNOWN | PLEASE SET REMAINING PAPER AMOUNT | | | | DISPLAY - |
| PAPER WIDTH CANNOT BE DETECTED | PLEASE CHECK PRINTING APPARATUS | | | DISPLAY - | REMAINING AMOUNT VALUE |
| | | | | | DISPLAY - |
| PAPER TYPE UNKNOWN | PRINTING IS AVAILABLE | | DISPLAY - | WIDTH VALUE | REMAINING AMOUNT VALUE |
| NO PAPER REMAINING | PLEASE INSERT MORE PAPER | | | | |
| REMAINING PAPER AMOUNT UNKNOWN | PLEASE SET REMAINING PAPER AMOUNT | | | | DISPLAY - |
| PAPER WIDTH CANNOT BE DETECTED | PLEASE CHECK PRINTING APPARATUS | | | DISPLAY - | REMAINING AMOUNT VALUE |
| | | | | | DISPLAY - |
| PAPER ROLL NOT MOUNTED | UNDEFINED | NOT DISPLAYED | NOT DISPLAYED | NOT DISPLAYED | NOT DISPLAYED |

PRINTING CONTROL APPARATUS, PRINTING MANAGEMENT METHOD, AND PRINTING SYSTEM

CROSS-REFERENCE TO RELATED APPLICATIONS

The present application claims priority to Japanese Patent Application No. 2014-152642 filed on Jul. 28, 2014, which is hereby incorporated by reference in its entirety.

BACKGROUND

1. Technical Field

The present invention relates to a printing control apparatus, a printing management method, and a printing system.

2. Related Art

A printing system that is configured of a plurality of printing apparatuses, a personal computer (PC) to control the printing apparatuses, and the like is known in the related art. The printing apparatuses include a large-size printing apparatus that performs printing on a comparatively large-size printing medium such as JIS standard A0 or B0 sheets. Each printing apparatus uses a cut paper or a paper roll as a printing paper. In addition, a multi-feed compatible printing apparatus is also installed in which a plurality of cut papers or paper rolls can be fed to one printing apparatus. The PC instructs each printing apparatus to perform printing and monitors various states, such as whether a paper roll is mounted in the printing apparatus (see JP-A-2010-6535).

The printing apparatus of JP-A-2010-6535, however, determines whether a paper roll is mounted by using a determining unit that determines whether a paper roll is detached from the printing apparatus. Thus, printing may not be performed even if a paper roll is mounted in the printing apparatus. Specifically, the printing apparatus determines that a paper roll is mounted even when an adapter that supports the paper roll with both ends is not correctly installed to the paper roll. The PC obtaining such information reports the information that the paper roll is mounted to a user. However, since the printing apparatus cannot be normally fed with the paper roll, printing may not be performed normally even if a printing instruction is output from the PC.

SUMMARY

An advantage of some aspects of the invention is to provide a printing control apparatus (PC) that reports a state of a printing apparatus to a user in an accurate and easily understandable manner.

The invention can be realized in the following forms or application examples.

Application Example 1

According to this application example, there is provided a printing control apparatus that is communicably connected to a printing apparatus, the apparatus including: a medium information obtaining unit that obtains medium information from the printing apparatus, the medium information including at least one of amount information of a medium mounted in the printing apparatus and mounted state information of the medium; a screen generating unit that generates an information display screen according to the medium information; and a display unit that displays the information display screen.

In this case, the information display screen is generated by the screen generating unit according to the medium information that is obtained from the printing apparatus. Thus, the information display screen is easily understandable to a user. When, for example, the medium mounted in the printing apparatus is printable, the information display screen can be generated by using an expression that is easily understandable to the user such as "printing available".

Therefore, it is possible to provide a printing control apparatus that reports a state of a printing apparatus to a user in an accurate and easily understandable manner.

Application Example 2

In the printing control apparatus according to the application example, the screen generating unit, when the medium information obtaining unit obtains the medium information about a plurality of the media from the printing apparatus, generates the information display screen that includes information about the plurality of the media.

In this case, it is possible to display the medium information about the plurality of the media mounted in the printing apparatus. Thus, the user can select an appropriate medium from the plurality of the media.

Application Example 3

In the printing control apparatus according to the application example, the screen generating unit makes a determination whether the medium is printable on the basis of the medium information and generates the information display screen according to a determination result.

In this case, it is possible to accurately determine whether the medium mounted in the printing apparatus is printable.

Application Example 4

In the printing control apparatus according to the application example, the information display screen includes at least one of character information that represents the determination result and image information.

In this case, the determination result is expressed by the character information and the image information. Thus, the user can easily understand the content of the determination result.

Application Example 5

In the printing control apparatus according to the application example, the information display screen, when the determination result does not indicate a printable state, is configured of only the character information.

In this case, when printing cannot be performed, it is possible to accurately and specifically transfer the fact by the character information. Thus, a waste of paper due to printing failure is suppressed.

Application Example 6

In the printing control apparatus according to the application example, the information display screen, when the determination result indicates a printable state, includes image information that represents the medium and the character information that indicates the amount information of the medium.

In this case, when printing can be performed, visibility of the user is increased by displaying the image information.

Meanwhile, the amount information of the medium is displayed by the character information that is easily identified from the image information. Such a configuration allows a printable state to be easily understandable and is able to accurately report a state of the medium in the printing apparatus to the user.

Application Example 7

In the printing control apparatus according to the application example, the information display screen includes the image information and the character information depending on whether the mounted state or the magnitude of the amount in the amount information of the medium.

In this case, it is possible to accurately report information related to the amount of the medium to the user. The user can predict the timing of adding the medium or changing the medium.

Application Example 8

In the printing control apparatus according to the application example, the screen generating unit generates an information of the determination result on the basis of a correspondence table in which a combination of each field of the medium information is associated with the determination result.

In this case, it is possible to draw the determination result that is accurately determined from various states of the medium by the correspondence table.

Application Example 9

According to this application example, there is provided a printing management method in which a state of a medium that is mounted in a printing apparatus is managed by a printing control apparatus that is communicably connected to the printing apparatus, the method including: obtaining medium information that includes at least one of amount information of the medium and mounted state information of the medium; generating an information display screen according to the medium information; and displaying the information display screen.

In this case, the information display screen is generated by the generating according to the medium information. Thus, the information display screen is easily understandable to the user. When, for example, the medium mounted in the printing apparatus is printable, the information display screen can be generated by using an expression that is easily understandable to the user such as "printing available". In a method of the related art, the user has to determine whether printing can be performed with only an event indicating that the medium is not detached. Meanwhile, in the printing management method, the user can perform printing with a high probability by acting according to the content of display on the information display screen.

Therefore, it is possible to provide a printing management method that reports a state of a printing apparatus to a user in a clear and easily understandable manner.

Application Example 10

According to this application example, there is provided a printing system that is provided with a printing apparatus which performs printing on a medium and a printing control apparatus which is communicably connected to the printing apparatus, the system including: the printing apparatus including a sensor unit that detects a detection signal which includes at least one of attachment/detachment detection of the medium and amount detection of the medium, an information computing unit that computes medium information which includes at least one of mounted state information and amount information of the medium on the basis of the detection signal, and a printing apparatus communication unit that transmits the medium information to the printing control apparatus; and the printing control apparatus including a medium information obtaining unit that obtains the medium information from the printing apparatus, a screen generating unit that generates an information display screen according to the medium information, and a display unit that displays the information display screen.

In this case, the information display screen is generated by the screen generating unit according to the medium information that is obtained from the printing apparatus. Thus, the information display screen is easily understandable to a user. When, for example, the medium mounted in the printing apparatus is printable, the information display screen can be generated by using an expression that is easily understandable to the user such as "printing available". In a method of the related art, the user has to determine whether printing can be performed with only an event indicating that the medium is not detached. Meanwhile, in the printing system, the user can perform printing with a high probability by acting according to the content of display on the information display screen.

Therefore, it is possible to provide a printing system that reports a state of a printing apparatus to a user in a clear and easily understandable manner.

BRIEF DESCRIPTION OF THE DRAWINGS

The invention will be described with reference to the accompanying drawings, wherein like numbers reference like elements.

FIGS. 4A and 4B are diagrams representing an example of a correspondence table.

DESCRIPTION OF EXEMPLARY EMBODIMENTS

Hereinafter, an embodiment of the invention will be described with reference to the drawings. Below is one embodiment of the invention which does not limit the invention. Each drawing below may be illustrated on a scale that is different from the actual scale for easy understanding.

First Embodiment

Summary of Printing System

Figure 1:
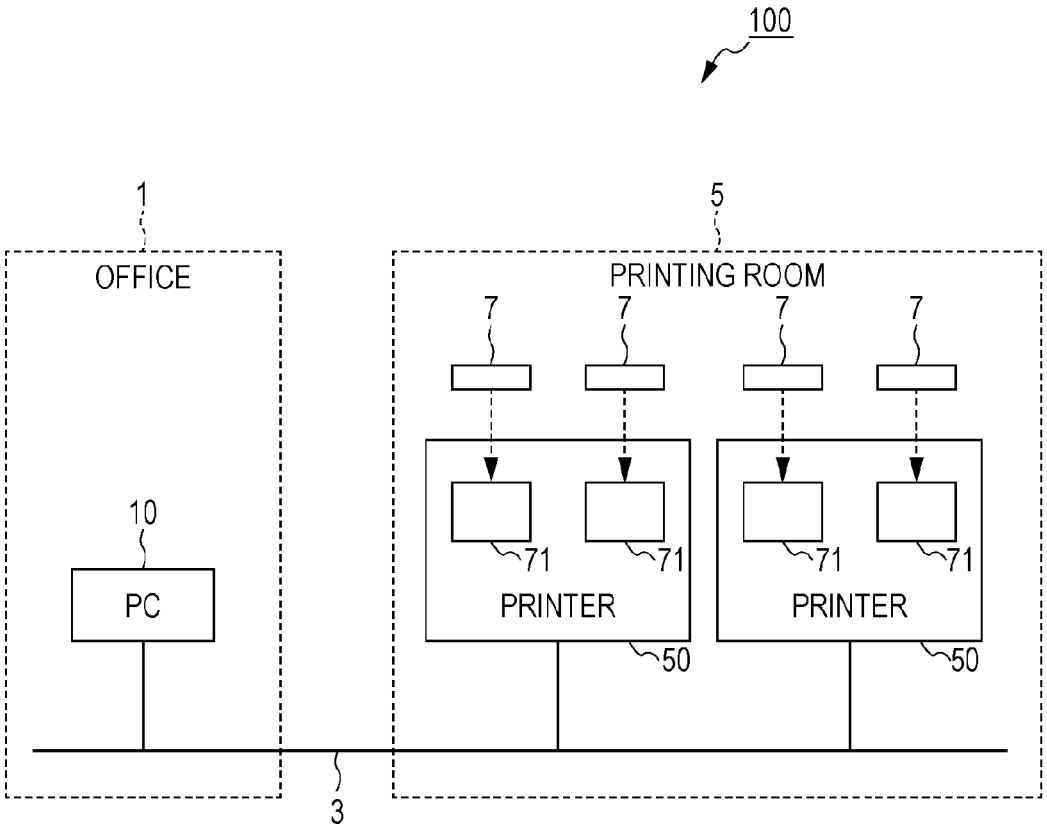
FIG. 1 is a diagram describing a schematic configuration of a printing system.
Figure 5:
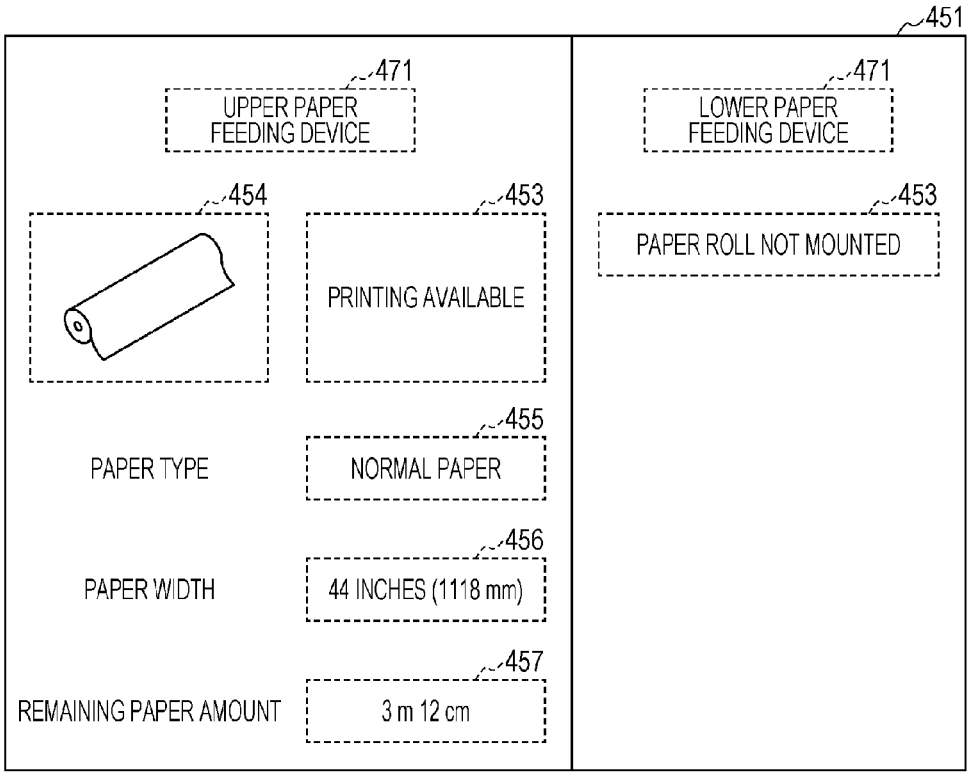
FIG. 5 is a diagram illustrating an example of an information display screen.

FIG. 1 is a diagram describing a schematic configuration of a printing system 100. FIG. 5 is a diagram illustrating an example of an information display screen.

The printing system 100 illustrated in FIG. 1 is a system that is used in a company and the like which use information devices. The printing system 100 is configured of a PC 10 that is installed in an office 1, a plurality of printers 50 that is installed in a printing room 5, and the like. The PC 10 is a general-purpose personal computer. Software and the like that monitor a printing status of the printer 50 and the like or instruct the printer 50 and the like to perform printing are executed on the PC 10.

The PC 10 and the printer 50 are communicably connected through a local area network (LAN) 3. Print data such as image data generated in the PC 10 is transmitted to the printer 50. The printer 50 prints the received print data on a printing paper that is specified by the PC 10. The printer 50 is provided with a plurality of paper feeding devices 71. In the printers 50 illustrated in FIG. 1, one printer 50 is provided with two paper feeding devices 71. The paper feeding device 71, as a preferred example, is a paper feeding mechanism that feeds a paper roll 7. The printer 50 that can be fed with the paper roll 7 is also provided with a mechanism that automatically cuts the paper roll 7 before and after printing, thus being capable of producing irregular printed matters that have various lengths or aspect ratios.

The PC 10 obtains information relevant to the mounted state of the paper roll 7, the remaining amount of paper, and the like from the printer 50. The PC 10 then generates information about whether the paper roll 7 mounted in the printer 50 is printable and reports the information to the user in an accurate and easily understandable manner. The display screen illustrated in FIG. 5 is an example of a screen displayed on a display device of the PC 10. In an "upper paper feeding device" section, the text "printing available" is displayed adjacent to an image icon of the paper roll 7. In a "lower paper feeding device" section, the text "paper roll not mounted" is displayed. The user can easily recognize from the "upper paper feeding device" section that printing on the paper roll 7 can be performed and from the "lower paper feeding device" section that it is necessary for the user to go to the printing room 5 and mount a paper roll so as to perform printing.

A printing apparatus and a PC in the related art sense an event indicating that the paper roll is not detached and notify the user that "paper roll is mounted". The user needs to check whether the printing apparatus can be normally fed with a paper roll before instructing printing to the printing apparatus. In order to do so, the user has to go to the printing room 5 and actually check the printing apparatus. In the present embodiment, the states of the paper feeding device 71 and the paper roll 7 in the printer 50 are transmitted to the user in an accurate and easily understandable manner. Thus, the user can instruct the printing apparatus to perform printing from the PC in a relaxed manner without going to the printing room 5.

Configurations of the printing system 100 and the PC 10 for realizing the effect will be described in detail below. The PC 10 corresponds to a printing control apparatus, and the printer 50 corresponds to a printing apparatus.

Summary of Printer 50

Figure 2:
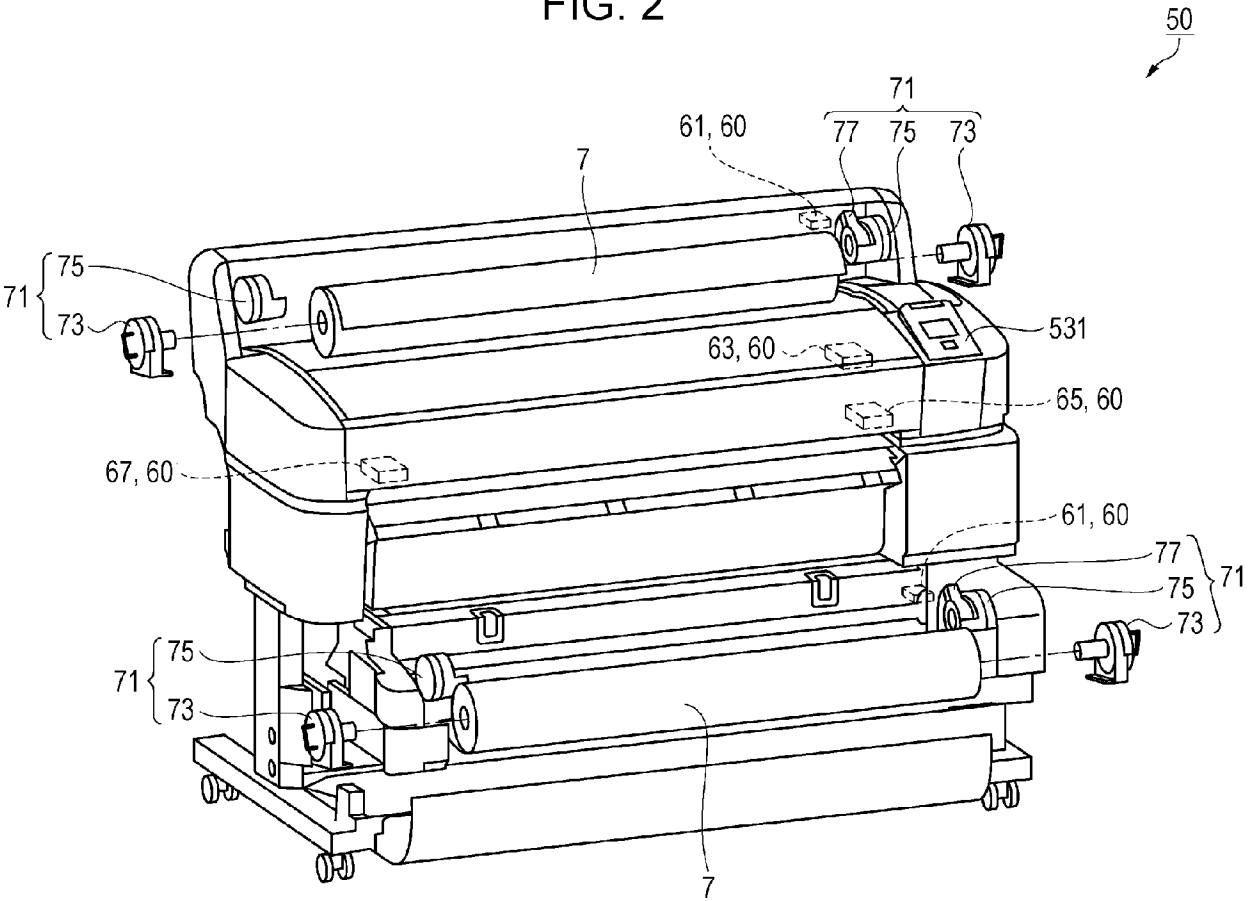
FIG. 2 is a perspective view illustrating schematically an exterior of a printer.

FIG. 2 is a perspective view illustrating schematically the exterior of the printer 50.

The printer 50 is a large-size ink jet printer that can perform printing on a comparatively large-size printing medium such as JIS standard A0 or B0 sheets. The paper roll 7 is an example of the printing medium and is fed as a printing paper wound into a roll. The printer 50 is configured with an operating panel 531, two (upper and lower) paper feeding devices 71, a sensor unit 60, and the like. These configurational units are controlled by a control unit 80 (described later) in a centralized manner. The printing medium and the paper roll 7 correspond to a medium.

The operating panel 531 is configured of a display device such as a liquid crystal display (LCD) and an input device such as a touch panel and an operating button. The display device displays various setting information and the like relevant to the printer 50. Various setting information is input to the input device through an operation by the user. For example, the user mounts the paper roll 7 in the paper feeding device 71 and sets the type of paper of the mounted paper roll 7 in the printer 50. Specifically, when the display device displays options such as "normal paper", "photo paper", and "mat paper", the user selects the type of paper of the mounted paper roll 7 from the displayed options and presses a confirm button. Information of the selected type of paper is output from the operating panel 531 to the control unit 80.

The paper feeding device 71 is configured with an adapter 73, an adapter holder 75, a lock lever 77, and the like.

The adapter 73 is an adapter component that is mounted at both ends of the core of the paper roll 7. The adapter 73 mounted at the paper roll 7 enables the paper roll 7 to rotate smoothly. The adapter 73 is a passive shaft unit and is rotated when a paper transporting force generated by a driving force on a paper transport path (not illustrated) inside the printer 50 transports paper drawn from the paper roll 7. The adapter 73 also acts as a brake to suppress rotation so that the paper fed from the paper roll 7 does not become slack.

The adapter holder 75 is a supporting component that supports the adapter 73 in the printer 50. The adapter holder 75 is fixed to a frame or a casing that is the structural framework of the printer 50.

The adapter holder 75 and the adapter 73 include fitting units so that the adapter holder 75 and the adapter 73 fit together. Both of the adapter holder 75 and the adapter 73 can slide while being engaged. Since the adapter holder 75 is fixed to the printer 50, the user slides the paper roll 7 at which the adapter 73 is mounted and moves the paper roll 7 inside the printer 50.

The lock lever 77 is a fixing component that fixes the adapter 73 and the adapter holder 75. The lock lever 77 is provided with a rotating lever unit. Rotating the lever unit by a predetermined angle (for example, approximately) 45° switches the lock lever 77 from a released state to a fixed state. When the adapter 73 slides to move to a predetermined position of the adapter holder 75, the lever unit of the lock lever 77 becomes rotatable, and rotating the lever unit by a predetermined angle fixes the adapter 73 and the adapter holder 75. The paper of the paper roll 7 can be fed by the paper feeding device 71 in the state where the adapter 73 and the adapter holder 75 are fixed by the lock lever 77.

The two upper and lower paper feeding devices 71 are mounted in the printer 50. Hereinafter, the upper one of the paper feeding devices 71 will be referred to as an upper paper feeding device, and the lower one of the paper feeding devices 71 will be referred to as a lower paper feeding device.

The sensor unit 60 is configured of an adapter attachment/detachment sensor 61, a paper width sensor 63, a paper remaining amount sensor 65, a paper shortage sensor 67, and the like. All of the sensors are controlled by the control unit 80, and various detection signals after sensing are output to the control unit 80.

The sensor unit 60 corresponds to a sensor unit of a printing apparatus.

The adapter attachment/detachment sensor 61 is a switch or optical sensor that detects when the lever unit of the lock lever 77 is rotated by a predetermined angle. The switch can be a small-size button switch having a structure in which the switch is pressed, while the optical sensor detects reflective light when the lever unit of the lock lever 77 is rotated by a predetermined angle. When rotation of the lever unit by a predetermined angle is detected, the adapter 73 is fixed to the adapter holder 75. At the same time, the paper roll 7 is mounted in the paper feeding device 71 and is able to be fed. A circuit that is electrically connected to the position of the lever unit rotated by a predetermined angle may also be provided to detect the rotation of the lever unit by a predetermined angle.

The adapter attachment/detachment sensor 61 corresponds to a structure for detecting an attachment/detachment of a medium.

The paper width sensor 63 is an optical sensor that detects the width of the fed paper. The paper width sensor 63 is provided in a carriage (not illustrated) that reciprocates widthwise of the paper and discharges ink to perform printing. The paper width sensor 63 detects the amount of change in light that is emitted from the reciprocating carriage and is reflected at a widthwise end of the paper. The amount of movement of the carriage is counted by using an encoder (not illustrated). Thus, the position where the amount of change in light is detected is computed, and the width of the paper is obtained.

The paper width sensor 63 is not necessarily provided in the carriage and may be an optical sensor provided in the adapter 73. The distance between the two adapters 73 mounted at both ends of the paper roll 7 may be computed by detecting the speed of light that is emitted from one adapter 73 and reaches the other adapter 73. The computed distance is output as the width of the paper.

The paper remaining amount sensor 65 is a sensor that detects the length of the remaining amount of paper of the mounted paper roll 7. The paper remaining amount sensor 65 is an optical sensor that reads a paper remaining amount marker, which is printed on the paper roll 7 when the paper roll 7 is mounted. The paper remaining amount marker is a marker, such as a barcode printed in a tip end portion of the paper of the paper roll 7. The paper remaining amount marker is printed when the paper roll 7 is manufactured. When the paper roll 7 still remaining is detached from the printing apparatus, that includes the printer 50, the paper remaining amount marker that includes information about the remaining amount of paper is printed in the tip end portion of the paper of the paper roll 7 before the paper roll 7 is detached.

The paper remaining amount sensor 65 may be a sensor that measures the weight of the paper roll 7 or may use a unit that computes the remaining amount of paper from a measured weight change. A method may also be used in which a sensor that measures the diameter of the paper roll 7 is provided to compute the remaining amount of paper from a change in diameter.

The paper remaining amount sensor 65 corresponds to a structure for detecting the amount of a medium.

The paper shortage sensor 67 is a sensor that detects a shortage of the remaining amount of paper of the paper roll 7. The paper shortage sensor 67 is an optical sensor that detects the trailing edge of the paper transported from the paper roll 7. The paper width sensor 63 provided in the carriage may be used to detect the trailing edge of the paper.

Block Diagram of Printing System

Figure 3:
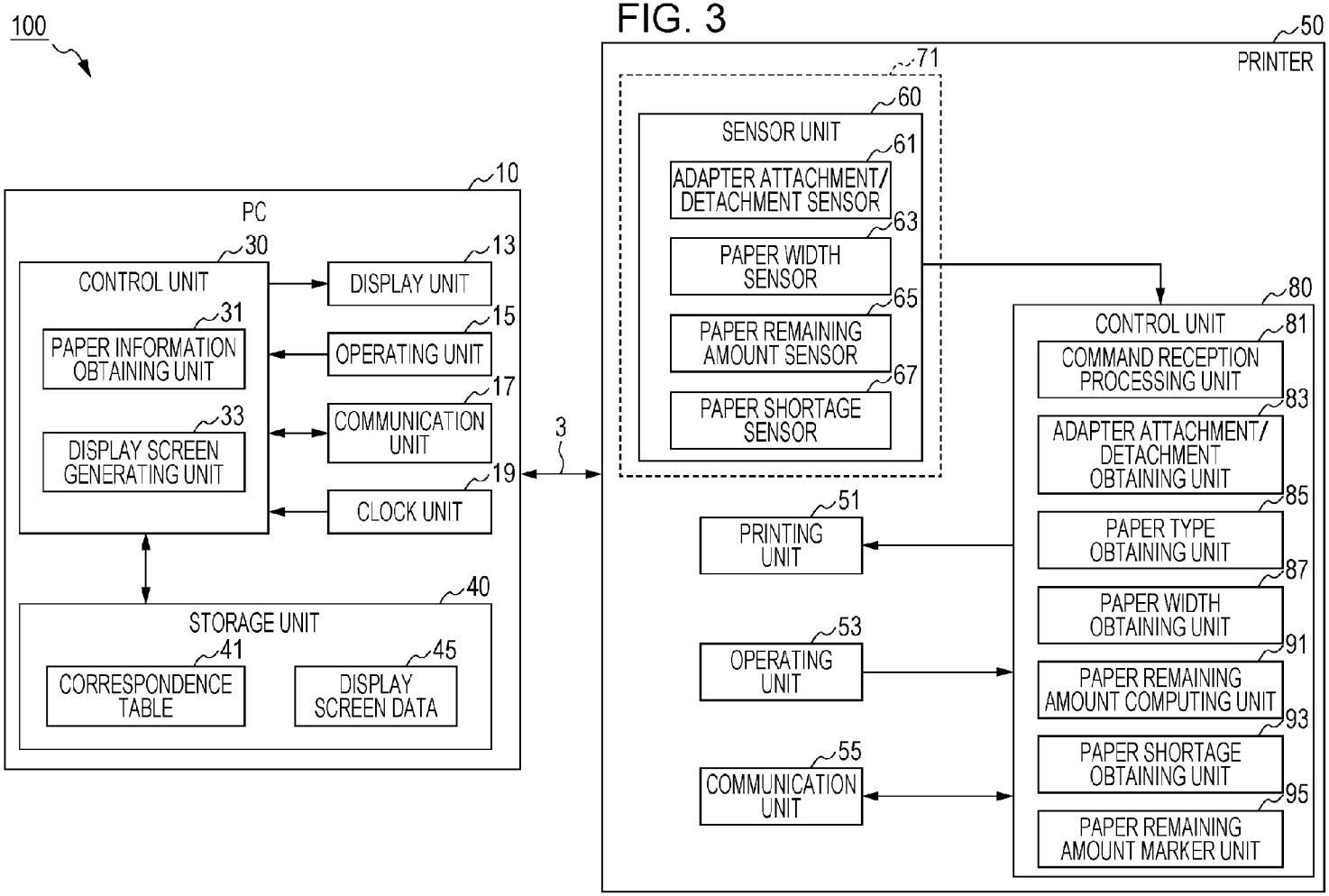
FIG. 3 is a block diagram illustrating a schematic configuration of the printing system.

FIG. 3 is a block diagram illustrating a schematic configuration of the printing system 100. The printing system 100 is configured of the PC 10, the printer 50, the LAN 3, and the like.

Block Diagram of PC 10

The PC 10 is a personal computer and is configured of a display unit 13, an operating unit 15, a communication unit 17, a clock unit 19, a control unit 30, a storage unit 40, and the like.

A liquid crystal panel is used in the display unit 13 as a preferred example. A touch panel may be provided in a display face of the display unit 13. The display unit 13 displays a display screen that is generated by control of the control unit 30. The display unit 13 corresponds to a displaying unit.

The operating unit 15 is an input device such as a keyboard or a mouse. The communication unit 17 is a network adapter. The communication unit 17 transmits and receives various data relevant to printing through the LAN 3 between the PC 10 and the printer 50. The clock unit 19 is a real-time clock and has time measuring functions such as a calendar function, a clock function, and a stopwatch function.

The control unit 30 is a central processing unit (CPU) and controls each unit constituting the PC 10 such as the display unit 13, the operating unit 15, the communication unit 17, the clock unit 19, and the storage unit 40.

The control unit 30 includes a paper information obtaining unit 31, a display screen generating unit 33, and the like as functional units that have hardware, software (programs, data, and the like), or both, and are configured to achieve a particular purpose. These functional units are written merely as an example. Not all of the functional units are necessarily essential constituents. Functional units other than these may be provided as essential constituents.

The paper information obtaining unit 31 obtains paper information that represents a state of the paper mounted in the paper feeding device 71 of the printer 50. Specifically, the paper information obtaining unit 31 controls the communication unit 17 to transmit a paper information request command to the printer 50 and waits for a response. When paper information representing a state of the paper is transmitted in return from the printer 50 as a response, the paper information obtaining unit 31 puts the content in an internal variable (storage unit 40). When a plurality of paper feeding devices 71 is provided in the printer 50, the paper information obtaining unit 31 obtains the paper information for each paper feeding device 71 and puts the paper information as many as the amount of the number of paper feeding devices 71 in the internal variable. The paper information transmitted from the printer 50 includes various information, such as (i) paper remaining amount information that is relevant to paper and is computed by the control unit 80 on the basis of a detection signal from the sensor unit 60 of the printer 50, (ii) information related to the mounted state of the paper, (iii) information related to the width of the paper, and (iv) a type of paper input by the operating panel 531. The paper information obtaining unit 31 outputs the obtained paper information to the display screen generating unit 33.

The paper information, the paper remaining amount information, the information related to the mounted state of the paper, and the paper information obtaining unit 31 correspond, respectively, to medium information, medium amount information, mounted state information, and a medium information obtaining unit.

The display screen generating unit 33 generates a display screen from the paper information that is input from the paper information obtaining unit 31 so as to display the display screen on the display unit 13. Specifically, the display screen generating unit 33 refers to a correspondence table 41 (described later) that is stored in advance on the storage unit 40 and obtains display information that corresponds to the paper information input from the paper information obtaining unit 31. The display information includes a state of the paper, character strings that represent whether a target paper is mounted and is printable, and information, such as whether to display icons to increase the visibility of the state of the paper and the character strings. The display screen generating unit 33 arranges character string data and icon data (not illustrated), that are stored on the storage unit 40 in a drawing storage area of the storage unit 40, on the basis of the display information to configure a display screen and stores the display screen on the storage unit 40 as display screen data 45.

The display screen generating unit 33 corresponds to a screen generating unit.

The storage unit 40 is configured of a storage device, such as a read-only memory (ROM), a flash ROM, a random access memory (RAM), a hard disk drive (HDD), or a solid state drive (SSD). The storage unit 40 stores various programs, data, and the like to realize the particular purposes of each functional unit of the control unit 30. The storage unit 40 also includes the drawing storage area such as a video RAM (VRAM); a work area that temporarily stores intermediate processing data, variable values, processing results, and the like in various processes; and the like.

The storage unit 40 stores the correspondence table 41, the display screen data 45, and the like.

FIGS. 4A and 4B are diagrams representing an example of a correspondence table. The correspondence table 41 is a table in which a correspondence between paper information 411 as input information and display information 421 as output information is defined.

The paper information 411 is information that is obtained by the paper information obtaining unit 31 in the PC 10 and is related to the paper feeding device 71 of the printer 50. The paper information 411 includes information about each field of adapter mounted 412, paper type set 413, paper width obtained 414, remaining amount information obtained 415, and paper remaining 416. The content of each field represents "1" in the case of "true" and "0" in the case of "false". For example, all of the fields are "1" in a combination 431 of the paper information, the combination 431 being a collection of fields in one or more lines of the paper information 411. This indicates a combination in which all of the fields in the paper information are "true".

The adapter mounted 412 is information that indicates whether the paper roll 7 is correctly mounted in the paper feeding device 71. Specifically, the adapter mounted 412 is information that is detected by the adapter attachment/detachment sensor 61 of the printer 50 and indicates whether the adapter 73 is mounted. The adapter mounted 412 being "true" indicates that the paper roll 7 is correctly mounted in the target paper feeding device 71 and is able to be fed if there is a remaining amount of the paper roll 7. The adapter mounted 412 being "false" indicates that the paper roll 7 is either not present in the paper feeding device 71 or not correctly mounted.

The paper type set 413 is information that indicates whether the type of paper of the paper roll 7 mounted in the target paper feeding device 71 is input by the operating panel 531 of the printer 50. The paper type set 413 being "true" indicates that the type of the mounted paper roll 7 is selected. The paper type set 413 being "false" indicates that the type of the mounted paper roll 7 is not selected.

The paper width obtained 414 is information that indicates whether information about the width of the paper can be obtained after the width of the paper of the paper roll 7 is detected by the paper width sensor 63. The paper width obtained 414 being "true" indicates that the width of the paper of the mounted paper roll 7 is obtained, and the paper width obtained 414 being "false" indicates that the width of the paper is not obtained.

The remaining amount information obtained 415 is information that indicates whether the remaining amount of paper of the mounted paper roll 7 is obtained. Specifically, the remaining amount information obtained 415 is information that indicates whether information about the paper remaining amount is obtained after the remaining amount of paper of the paper roll 7 is detected by the paper remaining amount sensor 65. The remaining amount information obtained 415 being "true" indicates that information about the remaining amount of the paper is obtained, and the remaining amount information obtained 415 being "false" indicates that the remaining amount of the paper is not obtained.

The paper remaining 416 is information that indicates whether paper for printing remains in the paper roll 7. Specifically, information about the remaining amount of paper is computed by detection information of the paper remaining amount sensor 65, the paper shortage sensor 67, and the control unit 80 of the printer 50. The paper remaining 416 being "true" indicates that there is paper remaining, and the paper remaining 416 being "false" indicates that there is no paper remaining. A determination of "true" and "false" of whether paper remains may be made as "false" regardless of the information of the paper remaining amount sensor 65 when the paper shortage sensor 67 detects a paper shortage. The determination of whether paper remains may be made as "true" when the paper shortage sensor 67 does not detect a paper shortage even if the information of the paper remaining amount sensor 65 indicates that there is no paper remaining.

Turning to FIG. 4B, the display information 421 is display information that is associated with each combination of the fields of the paper information 411 and constitutes a display screen, such as a displace screen presented on the display unit 13. The display information 421 includes information of a state message 422, an action message 423, a paper roll icon 424, a paper type display content 425, a paper width display content 426, and a paper remaining amount display content 427.

The state message 422 is character information reported to the user. In the state message 422, information related to a state of the paper information 411 is defined as a simple expression. A field in which "undefined" is written among the fields of the state message 422 means that character information is not defined in the field.

The action message 423 is character information reported to the user. In the action message 423, information that indicates a next action that the user has to take on the basis of the state of the paper information 411 and the display content of the state message 422 is defined as a simple expression. A field in which "undefined" is written among the fields of the action message 423 means that character information is not defined in the field.

The paper roll icon 424 is image information reported to the user. In the paper roll icon 424, information that indicates whether to display an icon having an image of the paper roll 7 is defined. The icon of the paper roll 7 is displayed in the case of "displayed" and is not displayed in the case of "not displayed". In the example of FIGS. 4A and 4B, the paper roll icon 424 is defined as "displayed" when a value of the adapter mounted 412 is "1" and as "not displayed" when a value of the adapter mounted 412 is "0".

The paper type display content 425 is character information indicating the type of paper. In the paper type display content 425, the type of paper obtained by the paper information obtaining unit 31 is displayed. When a value of the paper type set 413 is "1", the paper type display content 425 is defined as "paper type name character", and the obtained paper type name is displayed. When a value of the paper type set 413 is "0", the obtained name cannot be displayed. Thus, the paper type set 413 is defined as "display -", and "-" is displayed. When a value of the adapter mounted 412 is "0", the paper type set 413 is defined as "not displayed" regardless of the contents of other fields.

The paper width display content 426 is character information indicating the width of paper in a numerical value. In the paper width display content 426, the width of paper obtained by the paper information obtaining unit 31 is displayed. When a value of the paper width obtained 414 is "1", the paper width display content 426 is defined as "width value", and the value of the width of paper is displayed. When a value of the paper width obtained 414 is "0", the width of paper cannot be obtained. Thus, the paper width display content 426 is defined as "display -", and "-" is displayed. When a value of the adapter mounted 412 is "0", the paper width display content 426 is defined as "not displayed" regardless of the contents of other fields.

The paper remaining amount display content 427 is character information indicating the remaining amount of paper in a numerical value. In the paper remaining amount display content 427, the information about the remaining amount of paper obtained by the paper information obtaining unit 31 is displayed. When a value of the remaining amount information obtained 415 is "1", the paper remaining amount display content 427 is defined as "remaining amount value", and the value of the remaining amount of paper is displayed. When a value of the remaining amount information obtained 415 is "0", the remaining amount of paper cannot be obtained. Thus, the paper remaining amount display content 427 is defined as "display -", and "-" is displayed. When a value of the adapter mounted 412 is "0", the paper remaining amount display content 427 is defined as "not displayed" regardless of the contents of other fields.

The display information 421 corresponds to a determination result.

Stored in the display screen data 45 is image data generated by the display screen generating unit 33. The display screen data 45 is displayed on a liquid crystal panel and the like by the display unit 13 and is viewed by the user.

FIG. 5 is a diagram illustrating an example of an information display screen. An information display screen 451 illustrated in FIG. 5 represents a screen on which the display screen data 45 is displayed by the display unit 13. A plurality of display frames are arranged in the information display screen 451. The information display screen 451 has a structure of changeably displaying the display content of the display frame. The display frames are configured of a paper feeding device name frame 471, a message frame 453, an icon frame 454, a paper type frame 455, a paper width frame 456, and a paper remaining amount frame 457.

The paper feeding device name frame 471 displays the name of the paper feeding device 71. The text "upper paper feeding device" is written on the left side of the information display screen 451, and the text "lower paper feeding device" is written on the right side thereof. The information display screen 451 illustrates that the left side is paper information related to the "upper paper feeding device", and the right side is paper information related to the "lower paper feeding device". The display example of the "upper paper feeding device" on the left side is a screen display example in which the display information 421 in the case of the combination 431 of the paper information illustrated in FIGS. 4A and 4B is displayed. The display example of the "lower paper feeding device" on the right side is a screen display example in which the display information 421 in the case of a combination 433 is displayed, the combination 433 being a collection of fields in one or more lines of the paper information 411.

The message frame 453 displays character information of the state message 422 and the action message 423 defined in FIGS. 4A and 4B. Since the state message 422 is undefined, and the action message 423 is "printing available" in the combination 431, the message frame 453 of the "upper paper feeding device" displays the text "printing available" of the action message 423. Since the state message 422 is "paper roll not mounted", and the action message 423 is undefined in the combination 433, the message frame 453 of the "lower paper feeding device" displays the text "paper roll not mounted" of the state message 422. Although not illustrated, when both of the state message 422 and the action message 423 are defined, character information of both of the state message 422 and the action message 423 is displayed in the message frame 453.

The icon frame 454 displays or does not display an image depending on the content defined in the paper roll icon 424 (FIGS. 4A and 4B). Since the paper roll icon 424 is "displayed" in the combination 431, the icon frame 454 of the "upper paper feeding device" displays an image that represents an image of the paper roll 7. Since the paper roll icon 424 is "not displayed" in the combination 433, the icon frame 454 of the "lower paper feeding device" does not display an icon.

The display content of the paper type frame 455 is determined depending on the content defined in the paper type display content 425 (FIGS. 4A and 4B). Since the paper type display content 425 is "paper type name character" in the combination 431, the paper type frame 455 of the "upper paper feeding device" displays a character string of "normal paper" that is the name of the obtained type of paper. Since the paper type display content 425 is "not displayed" in the combination 433, the paper type frame 455 of the "lower paper feeding device" does not display a type of paper.

The display content of the paper width frame 456 is determined depending on the content defined in the paper width display content 426 (FIGS. 4A and 4B). Since the paper width display content 426 is "width value" in the combination 431, the paper width frame 456 of the "upper paper feeding device" displays the text "44 inches (1118 mm)" that is the value of the obtained width of paper. Since the paper width display content 426 is "not displayed" in the combination 433, the paper width frame 456 of the "lower paper feeding device" does not display a width of paper.

The display content of the paper remaining amount frame 457 is determined depending on the content defined in the paper remaining amount display content 427 (FIGS. 4A and 4B). Since the paper remaining amount display content 427 is "remaining amount value" in the combination 431, the paper remaining amount frame 457 of the "upper paper feeding device" displays the text "3 m 12 cm" that is the value of the obtained remaining amount of paper. Since the paper remaining amount display content 427 is "not displayed" in the combination 433, the paper remaining amount frame 457 of the "lower paper feeding device" does not display a remaining amount of paper.

Block Diagram of Printer 50

FIG. 3 is referred to again.

The printer 50 is configured of a printing unit 51, an operating unit 53, a communication unit 55, the sensor unit 60, the control unit 80, and the like. The printer 50 may be configured to be provided with a plurality of paper feeding devices 71. In this case, one set of the sensor unit 60 is configured for one paper feeding device 71.

The printing unit 51 is configured of a printer application-specific integrated circuit (ASIC), a printer engine (all not illustrated), and the like. The printer ASIC is an integrated circuit that controls the printer engine. The printer ASIC, when receiving a printing instruction from the control unit 80, generates print data on the basis of printing instruction target print objects, arrangement information of the print objects, and the like and controls the printer engine so as to output the print data on a printing paper such as the paper roll 7. The printer engine is configured to include a known ink jet printer mechanism that performs printing by discharging ink to the printing paper from a printing head.

The operating unit 53 is configured to be provided with the above operating panel 531. The operating unit 53 obtains information about the type of paper of the paper roll 7 through a user operation under control of the control unit 80 and outputs the obtained information about the type of paper to the control unit 80.

The communication unit 55 is a wireless local area network (LAN) adapter or the like. The communication unit 55 receives original image data to print by using Internet Protocol (IP) from the PC 10 or transmits and receives various commands and other data with the PC 10. The communication unit 55 receives a paper information request command transmitted from the PC 10 and outputs the paper information request command to the control unit 80. The control unit 80, when obtaining paper information data for each paper feeding device 71, transmits the paper information data to the PC 10 through the communication unit 55 as a response command to the paper information request command. The communication unit 55 corresponds to a printing apparatus communication unit.

The sensor unit 60 is configured of the above adapter attachment/detachment sensor 61, the paper width sensor 63, the paper remaining amount sensor 65, the paper shortage sensor 67, and the like.

The control unit 80 is configured of an operation processing device such as a central processing unit (CPU), a read-only memory (ROM), a random access memory (RAM), a non-volatile random access memory (NVRAM), or an electrically erasable programmable read-only memory (EEPROM); a volatile memory; a non-volatile memory; and the like. The control unit 80 may be an ASIC into which these constituents are incorporated. The control unit 80 controls each unit such as the printing unit 51, the operating unit 53, the communication unit 55, the sensor unit 60, and the like of the printer 50.

The control unit 80 includes a command reception processing unit 81, an adapter attachment/detachment obtaining unit 83, a paper type obtaining unit 85, a paper width obtaining unit 87, a paper remaining amount computing unit 91, a paper shortage obtaining unit 93, a paper remaining amount marker unit 95, and the like as functional units that include hardware, software (programs, data and the like), or both and are configured to achieve a particular purpose for the function units. These functional units are written merely as an example. Not all of the functional units are necessarily essential constituents. Functional units other than these may be provided as essential constituents.

The adapter attachment/detachment obtaining unit 83, the paper type obtaining unit 85, the paper width obtaining unit 87, the paper remaining amount computing unit 91, and the paper shortage obtaining unit 93 correspond to an information computing unit of a printing apparatus.

The command reception processing unit 81 is a main loop that collectively controls events occurring in the printer 50. The command reception processing unit 81 receives events such as reception of a command and occurrence of a sensing an interruption and assigns each event to a corresponding functional unit to process the event. Specifically, when a command indicating that information about the type of paper is obtained by the operating unit 53 is received, the paper type obtaining unit 85 processes the command. When an interruption indicating an occurrence of an attachment/detachment signal of the adapter 73 is input from the adapter attachment/detachment sensor 61, the adapter attachment/detachment obtaining unit 83 processes the interruption. When the width of paper is detected by the paper width sensor 63, the paper width obtaining unit 87 processes the width of paper. When information about the remaining amount of paper of the mounted paper roll 7 is input from the paper remaining amount sensor 65, the paper remaining amount computing unit 91 processes the information and computes the remaining amount of paper. When a shortage of paper is detected by the paper shortage sensor 67, the paper shortage obtaining unit 93 processes the event.

The command reception processing unit 81, when receiving a paper information request command transmitted from the PC 10, transmits paper information that is obtained or computed by each functional unit to the PC 10 through the communication unit 55 as a response.

The paper remaining amount marker unit 95 is a process that is performed when the paper roll 7 is detached during use. The paper remaining amount marker unit 95 prints a paper remaining amount marker in a tip end portion of the paper of the paper roll 7. The paper remaining amount marker is a marker such as a barcode or a general two-dimensional code, and is printed in the form of a marker pattern of numbers that indicate the length of the remaining amount of paper.

The paper remaining amount computing unit 91, when obtaining information about the remaining amount of paper that is detected by the paper remaining amount sensor 65, uses the value of the obtained remaining amount of paper as an initial value and updates the information about the remaining amount of paper by subtracting the amount of feeding the paper of the paper roll 7 in printing from the initial value.

Process Flow of Control Program in PC

Figure 6:
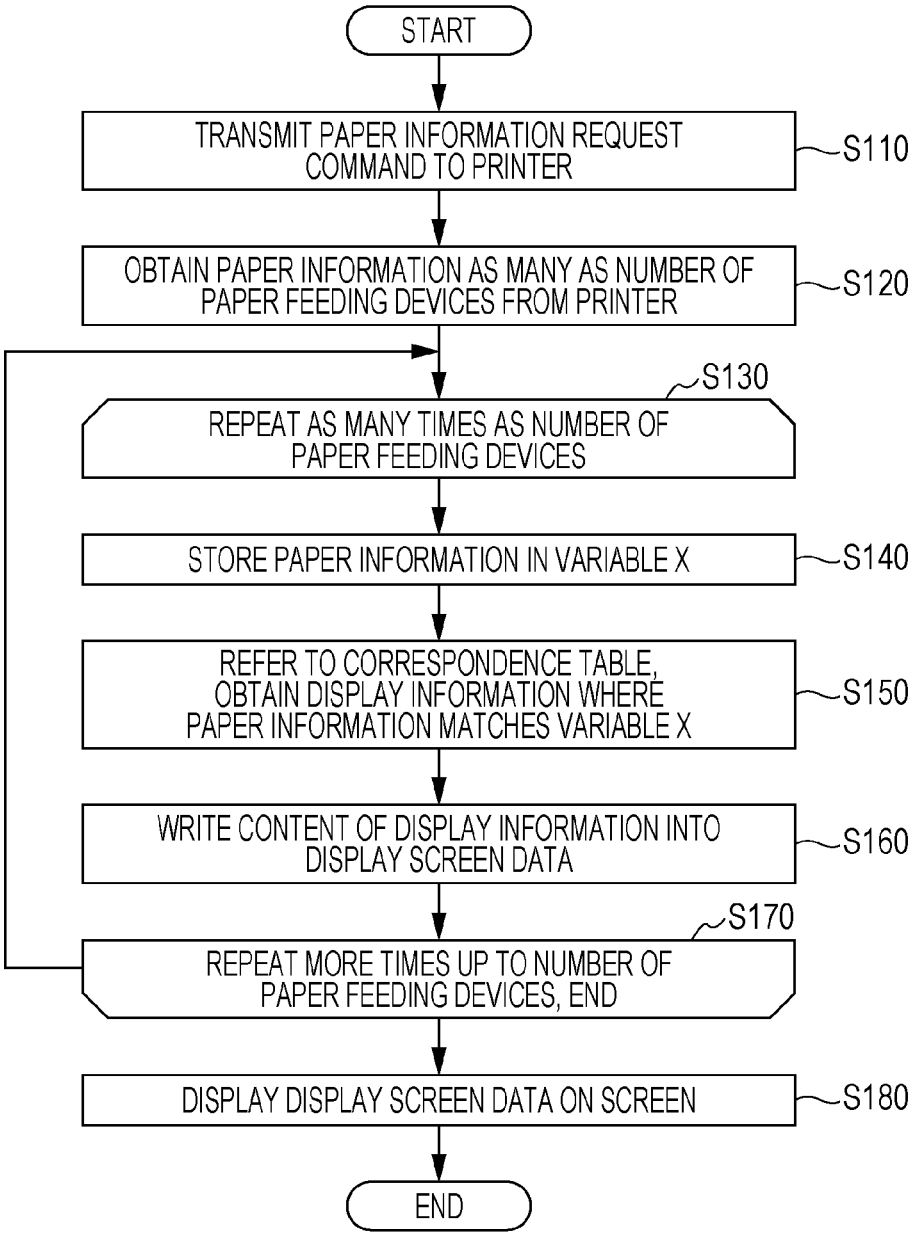
FIG. 6 is a flowchart illustrating a flow of an information displaying process.

FIG. 6 is a flowchart illustrating a flow of an information displaying process.

The flow described below is performed by the control unit 30 controlling each unit including the communication unit 17 and the storage unit 40 on the basis of a control program (not illustrated) stored on the storage unit 40 of the PC 10. Performing this flow realizes functions of the paper information obtaining unit 31, the display screen generating unit 33, and the display unit 13.

This flow corresponds to a printing management method.

In step S110, a paper information request command is transmitted to the printer 50.

In step S120, paper information is obtained from the printer 50 and as many paper feeding devices 71 associated with the printer 50. Specifically, when a plurality of paper feeding devices 71 is provided in the printer 50, paper information that corresponds to all of the paper feeding devices 71 provided is obtained even if the paper roll 7 is not mounted.

Step S120 corresponds to obtaining medium information.

In step S130, the process is repeated as many times as the amount of the number of paper feeding devices 71. A series of processes of step S130 to S170 is performed for one paper feeding device 71, and the process is repeated by the number of times corresponding to the number of paper feeding devices 71 provided.

In step S140, the paper information is stored in a variable X. Specifically, the variable X is, for example, a one-byte variable and stores "1" and "0" in units of bits. Each bit is given b7 to b0 in order from the most significant bit (MSB) to the least significant bit (LSB), and the content of the obtained paper information is set to each bit. Specifically, the adapter mounted 412 (FIGS. 4A and 4B) is assigned to b7, the paper type set 413 to b6, the paper width obtained 414 to b5, the remaining amount information obtained 415 to b4, and the paper remaining 416 to b3, and true or false is set as "1" or "0" for each.

In step S150, the correspondence table 41 (FIGS. 4A and 4B) is referred to, and the display information 421 in which the paper information 411 matches the variable X is obtained. Specifically, the paper information that corresponds to the paper feeding device 71 and is stored in the variable X is compared with the paper information 411 in the correspondence table 41. A variable Y is created by assigning the values of the paper information 411 in the correspondence table 41 to each bit of the variable Y, and the display information 421 that corresponds to the paper information 411 in which the bits b7 to b3 of the variable X match those of the variable Y is obtained.

In step S160, the contents of the display information 421 are written into the display screen data 45. Specifically, a display screen is generated according to the specified contents of the state message 422, the action message 423, the paper roll icon 424, the paper type display content 425, the paper width display content 426, and the paper remaining amount display content 427 represented in the display information 421 obtained in step S150, and the display screen is stored in the display screen data 45 of the storage unit 40. When there are a plurality of paper feeding devices 71, a generated display screen is added to the display screen data 45.

Steps S140 to S160 correspond to generating a screen.

In step S170, the process ends after being repeated as many times as the number of paper feeding devices 71. Steps S130 to S170 are repeated, and the display screen data 45 that includes information for each paper feeding device 71 provided in the printer 50 is generated and stored.

In step S180, the display screen data 45 is displayed on a screen. Specifically, the display screen data 45 that is generated for each paper feeding device 71 is displayed on the display device.

Step S180 corresponds to displaying.

According to the present embodiment, as described above, the following effect can be obtained.

The paper information obtaining unit 31 obtains paper information that indicates a state of paper relevant to the paper roll 7 which is detected by the printer 50. The paper information includes various information related to paper, such as the mounted state of paper, the type of paper, the width of paper, the remaining amount of paper, and the like. The display screen generating unit 33 refers to the correspondence table 41 and determines from the obtained paper information whether the target paper is printable. Specifically, the correspondence table 41 (FIGS. 4A and 4B) represents the display information 421 that includes the state message 422 and the action message 423 in which determination results are expressed for each combination of the fields of the paper information 411.

Accordingly, a determination of whether the target paper is printable is performed in the PC 10 on the basis of various paper information. The information display screen 451 (FIG. 5) that is generated according to a determination result is configured as a display screen that allows the user to easily recognize whether paper is printable. In the technology of the related art, a user has to make an instruction to perform printing according to only an event of whether a medium is detached. In the present embodiment, since a determination of whether paper is printable is performed in the PC 10, printing is highly likely to succeed in the printer 50 when it is determined that paper is printable, and the user can instruct the printer 50 to perform printing in a relaxed manner.

The paper information that is detected by the printer 50 and is obtained by the paper information obtaining unit 31 includes various information. Thus, the display screen generating unit 33 can draw an accurate determination result from an abundant amount of information as illustrated in the display information 421 (FIGS. 4A and 4B). Furthermore, since a determination of whether paper is printable is made in the display information 421, it is possible to generate the information display screen 451 by using expressions that are easily understandable to the user such as "printing available".

Therefore, it is possible to provide the PC 10 that reports whether the printer 50 can perform printing on a printing paper to the user in an accurate and easily understandable manner.

First Modification Example

While information about the remaining amount of the paper roll 7 is configured as an information display screen that displays a message related to whether the paper roll 7 remains in the above embodiment, the invention is not limited to this configuration. Not only whether the paper roll 7 remains but also the magnitude of the remaining amount may be configured in the information display screen. First, the information about the remaining amount of paper obtained by the paper information obtaining unit 31 is compared with a predetermined medium amount information, and the magnitude of the remaining amount is determined. When the magnitude of the remaining amount is determined, an icon and a message corresponding to the magnitude are displayed. The icon and the message may be displayed as overwriting the icon and the message defined in the display information 421 of the correspondence table 41 illustrated in FIGS. 4A and 4B. The icon and the message will be specifically described for cases below.

When the remaining amount of the paper roll 7 is small, for example, given that the predetermined medium amount information indicating a small remaining amount is 50 cm, a determination of whether the obtained information about the remaining amount of paper is less than or equal to 50 cm is performed by the PC 10. In the case of less than or equal to 50 cm, an icon and a message indicating a small remaining amount are displayed, the text "small amount of paper remaining" is displayed in the message frame 453 instead of the text "printing available" that is typically displayed, and the remaining amount of paper being small is specified.

Although not illustrated, an exclamation point mark that is an image for drawing an attention may be superimposed on an image that images the paper roll 7 displayed in the icon frame 454. Each of the paper type frame 455, the paper width frame 456, and the paper remaining amount frame 457 displays the paper information obtained by the paper information obtaining unit 31.

When the remaining amount of the paper roll 7 is sufficient, for example, given that the predetermined medium amount information indicating a sufficient remaining amount is greater than or equal to 3 m, a determination of whether the obtained information about the remaining amount of paper is greater than or equal to 3 m is performed by the PC 10. In the case of greater than or equal to 3 m, an icon and a message indicating a sufficient remaining amount are displayed, the text "sufficient amount of paper remaining" is displayed in the message frame 453 instead of the text "printing available" that is typically displayed, and the remaining amount of paper being sufficient is specified. Although not illustrated, a mark "○" that images the fact that paper is sufficient, and printing can be performed in a relaxed manner may be superimposed on the image that images the paper roll 7 displayed in the icon frame 454. Each of the paper type frame 455, the paper width frame 456, and the paper remaining amount frame 457 displays the paper information obtained by the paper information obtaining unit 31.

A display screen that is displayed when paper of the paper roll 7 remaining is "false", although not illustrated, may be configured by overwriting the image that images the paper roll 7 displayed in the icon frame 454 with an image that images the core of the paper roll 7 without paper. Each of the paper type frame 455, the paper width frame 456, and the paper remaining amount frame 457 displays the paper information obtained by the paper information obtaining unit 31.

According to such a modification example, information related to the remaining amount of paper of the paper roll 7 can be accurately reported to the user. The user can predict the timing of changing the paper roll 7 to a new paper roll 7.

Second Modification Example

A description will be provided by using FIGS. 7A and 7B and FIGS. 8A and 8B.

FIGS. 7A and 7B and FIGS. 8A and 8B are diagrams illustrating examples of the information display screen in a second modification example. These diagrams are modification examples of the information display screen that represents the paper roll not being mounted.

While a display screen that is configured of only the paper feeding device name frame 471 and the message frame 453 as the information display screen 451 (FIG. 5) is illustrated in the above embodiment when the paper roll 7 is not mounted, the invention is not limited to this configuration. A display screen may be configured to include an icon that represents the paper roll 7 not being mounted.

Figure 7A:
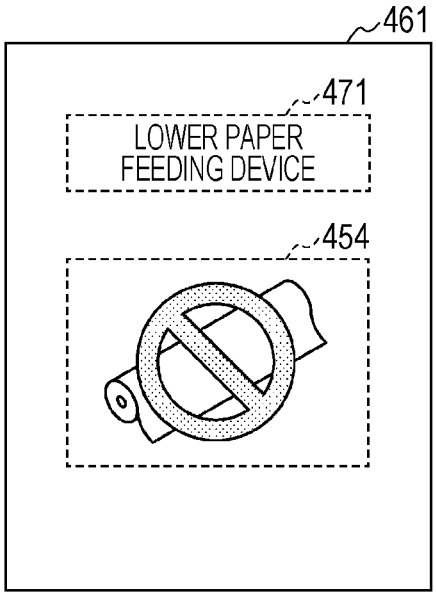
FIGS. 7A and 7B are diagrams illustrating examples of an information display screen in a modification example.

An information display screen 461 illustrated in FIG. 7A includes the paper feeding device name frame 471 and the icon frame 454, and the icon frame 454 displays an icon in which an image that images prohibition of use is superimposed on the image that images the paper roll 7 in the icon frame 454.

Figure 7B:
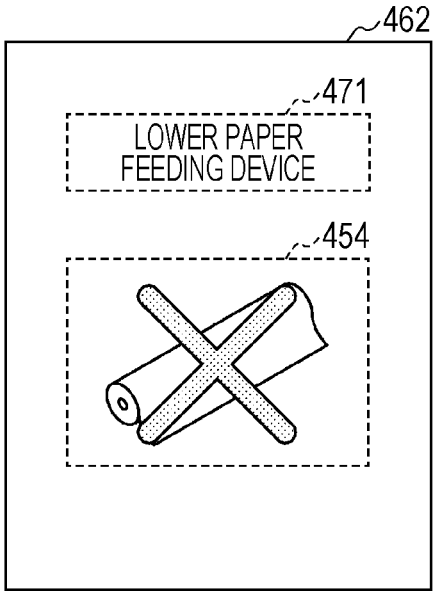

An information display screen 462 illustrated in FIG. 7B includes the paper feeding device name frame 471 and the icon frame 454, and the icon frame 454 displays an icon in which an image that images unavailability is superimposed on the image that images the paper roll 7 in the icon frame 454.

Figure 8A:
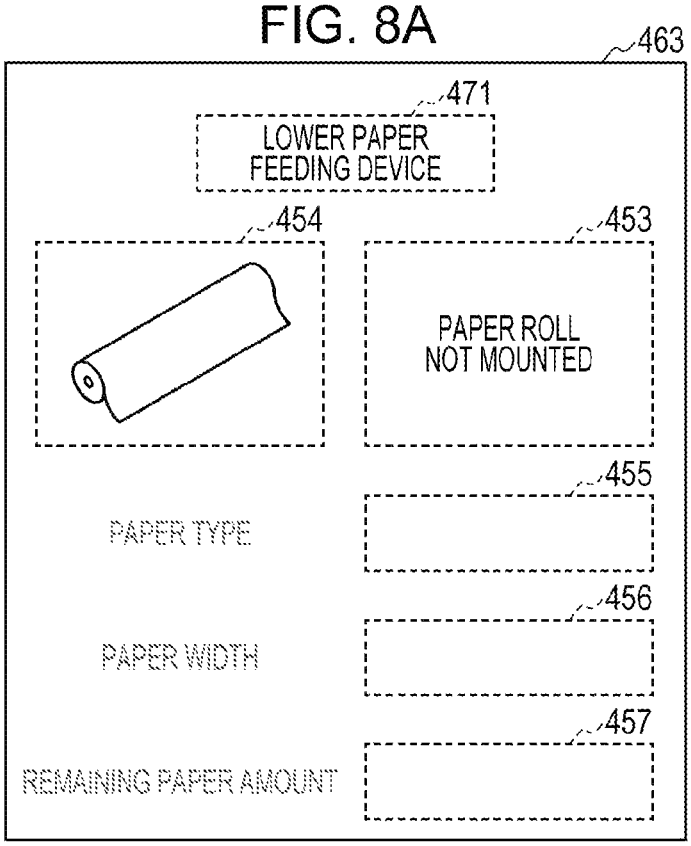
FIGS. 8A and 8B are diagrams illustrating examples of the information display screen in the modification example.

An information display screen 463 illustrated in FIG. 8A includes the paper feeding device name frame 471, the message frame 453, the icon frame 454, the paper type frame 455, the paper width frame 456, and the paper remaining amount frame 457. The icon frame 454 displays the image that images the paper roll 7, and the message frame 453 displays the text "paper roll not mounted". The paper type frame 455, the paper width frame 456, and the paper remaining amount frame 457 are displayed as blank, and characters describing each of these frames are grayed out.

Figure 8B:
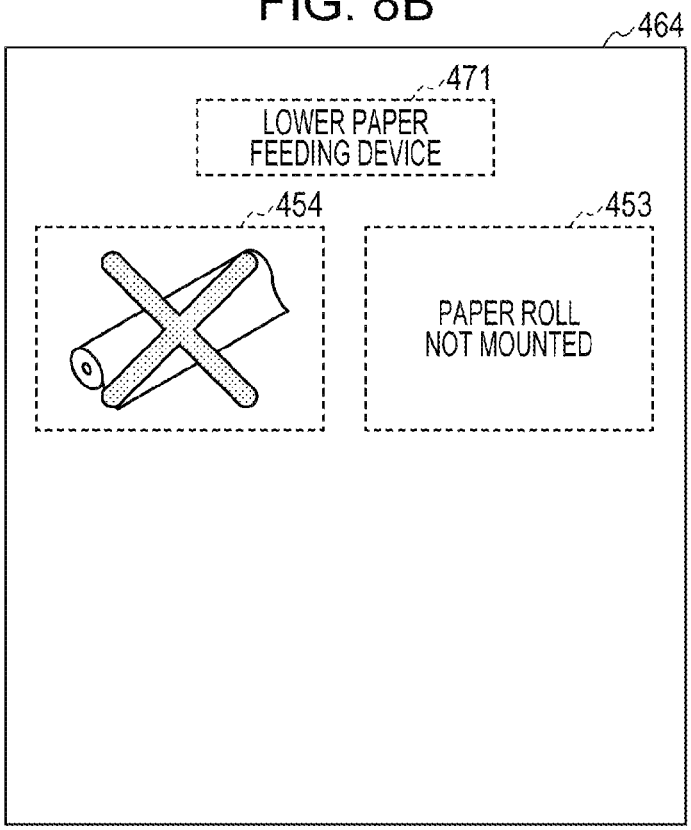

An information display screen 464 illustrated in FIG. 8B includes the paper feeding device name frame 471, the message frame 453, and the icon frame 454. The icon frame 454 displays the image that images unavailability being superimposed on the image that images the paper roll 7. The message frame 453 displays the text "paper roll not mounted".

Even in each information display screen illustrated in such a modification example, an expression that is easily understandable to the user can be realized.

Third Modification Example

While the correspondence table 41 (FIGS. 4A and 4B) is stored in advance on the storage unit 40 in the above embodiment and the modification examples, the invention is not limited to this configuration. The correspondence table 41 may be configured to be updated. When, for example, a new sensor that obtains further detailed information is added to the sensor unit 60 of the printer 50, such a configuration updates the correspondence table 41 on the basis of the information.

Accordingly, the display information 421 can be further varied, and a status relevant to the printer 50 can be accurately provided to the user.

Fourth Modification Example

While one correspondence table 41 (FIGS. 4A and 4B) is stored on the storage unit 40 in the above embodiment and the modification examples, the invention is not limited to this configuration. A plurality of correspondence tables 41 may be stored for each printing apparatus connected. When printing apparatuses connected to the printing system 100 have different specifications, such a configuration can provide the user with information according to the specification specific to a printing apparatus.

What is claimed is:

1. A printing control apparatus that is communicably connected to a printing apparatus, the apparatus comprising:

a medium information obtaining unit that obtains medium information from the printing apparatus, the medium information including at least one of amount information of a medium mounted in the printing apparatus and mounted state information of the a medium mounted in the printing apparatus;

a screen generating unit that generates an information display screen according to the medium information; and a display unit that displays the information display screen, wherein the screen generating unit generates the information display screen, which shows whether the printing apparatus is capable of printing on the medium or not, according to the following process based on the medium information:

a first determination that determines whether the medium is mounted in a paper feeding device or not;

when it is determined that the medium is mounted in the paper feeding device, a second determination that determines whether medium remaining information can be obtained or not; and when it is determined that the medium remaining information can be obtained, a third determination that determines whether the medium remains or not.

2. The printing control apparatus according to claim 1, wherein the screen generating unit generates the information display screen that shows the printing apparatus is capable of printing on the medium when the medium is mounted in the paper feeding device, the medium remaining information is obtained, and the medium remains; and wherein the screen generating unit generates the information display screen that shows the printing apparatus is not capable of printing on the medium when one of the following occurs:

the medium is not mounted in the paper feeding device;

the medium remaining information cannot be obtained; or the medium does not remain.

3. The printing control apparatus according to claim 2, wherein the screen generating unit, when the medium information obtaining unit obtains the medium information about a plurality of the paper feeding devices from the printing apparatus, generates the information display screen that includes the medium information about each of the plurality of the paper feeding devices.

4. A printing system that is provided with a printing apparatus which performs printing on a medium and a printing control apparatus which is communicably connected to the printing apparatus, the system comprising:

the printing apparatus including a sensor unit that detects a detection signal which includes at least one of attachment/detachment detection of the medium and amount detection of the medium, a paper feeding device, an information computing unit that computes medium information which includes at least one of mounted state information and amount information of the medium on the basis of the detection signal, and a printing apparatus communication unit that transmits the medium information to the printing control apparatus; and the printing control apparatus including a medium information obtaining unit that obtains the medium information from the printing apparatus, a screen generating unit that generates an information display screen according to the medium information, and a display unit that displays the information display screen, wherein the screen generating unit generates the information display screen, which shows whether the printing apparatus is capable of printing on the medium or not, according to the following process based on the medium information:

a first determination that determines whether the medium is mounted in the paper feeding device or not;

when it is determined that the medium is mounted in the paper feeding device, a second determination that determines whether medium remaining information can be obtained or not; and when it is determined that the medium remaining information can be obtained, a third determination that determines whether the medium remains or not.

* * * * *